US006761022B2

(12) United States Patent
Zipperer

(10) Patent No.: US 6,761,022 B2
(45) Date of Patent: Jul. 13, 2004

(54) METHOD AND APPARATUS TO MONITOR A YARN PIECING JOINT ON A SPINNING MACHINE

(75) Inventor: Martin Zipperer, Denkendorf (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 166 days.

(21) Appl. No.: 09/995,008

(22) Filed: Nov. 27, 2001

(65) Prior Publication Data

US 2002/0073683 A1 Jun. 20, 2002

(30) Foreign Application Priority Data

Feb. 12, 2000 (DE) ..... 100 59 967

(51) Int. Cl.[7] ..... D01H 4/50; D01H 13/32
(52) U.S. Cl. ..... 57/263; 57/264
(58) Field of Search ..... 57/22, 23, 202, 57/263, 264, 265, 404, 261

(56) References Cited

U.S. PATENT DOCUMENTS 4,084,398 A * 4/1978 Stahlecker et al. ..... 57/263
5,119,308 A 6/1992 Samoto
5,159,804 A * 11/1992 Schippers et al. ..... 57/261
5,801,949 A 9/1998 Raasch et al.
6,035,622 A * 3/2000 Fox et al. ..... 57/263
6,314,712 B1 11/2001 Thierron
6,339,921 B1 * 1/2002 Lassmann et al. ..... 57/264

FOREIGN PATENT DOCUMENTS

DE 19649314 6/1997
DE 19649329 6/1997
JP 06128825 A * 5/1994 ..... D01H/15/007

OTHER PUBLICATIONS

German Patent Office Search Report, Jul. 20, 2001.

* cited by examiner

*Primary Examiner*—John J. Calvert
*Assistant Examiner*—Shaun R Hurley
(74) *Attorney, Agent, or Firm*—Dority & Manning

(57) ABSTRACT

The invention relates to a method and an apparatus to monitor a yarn piecing joint on a spinning machine with a plurality of piecing stations to which a piecing robot equipped with a yarn piecing apparatus with adjustable yarn piecing speed can be presented, whereby each spinning station or the piecing robot is provided with a yarn monitoring apparatus to monitor the yarn quality. The piecing robot and the yarn monitoring apparatus of the spinning station are connected via a communication system through which the piecing parameters of the piecing robot are transmitted to the yarn monitoring apparatus.

22 Claims, 3 Drawing Sheets

METHOD AND APPARATUS TO MONITOR A YARN PIECING JOINT ON A SPINNING MACHINE

BACKGROUND

The invention relates to a process and an apparatus to monitor a yarn piecing joint on a spinning machine with a plurality of spinning stations to which a piecing robot equipped with a yarn piecing apparatus with adjustable yarn piecing speed can be presented, with each spinning station or the piecing robot having a yarn monitoring apparatus to monitor yarn quality.

In a known yarn or thread cleaner for an open-end spinning machine (German patent 39 28 417 A1) respective thickness tolerance thresholds for different length ranges are entered to monitor the yarn quality of the spun yarn. When the yarn thickness tolerance is exceeded, the affected segment of the yarn is cut out and the yarn is pieced anew. The quality criteria essentially depend on the length and the diameter of the spun yarn, so that the length of the measured yarn must be known precisely to judge whether the quality criterion for the corresponding length class has been met or not. The length is here measured by entering the yarn production speed of the spinning machine which is constant once the nominal yarn production speed has been reached, and by measuring the time. The yarn length then results by multiplying the time with the yarn draw-off speed. During the piecing phase the yarn is however accelerated from the yarn draw-off speed to the nominal production speed, so that here no constant yarn draw-off speed is determined. It is therefore not possible to classify yarn defects during the piecing phase, since the yarn cleaner is lacking information concerning yarn length.

In a known apparatus of this type to monitor a yarn piecing joint on a spinning machine (German patent 40 30 100 A1), a yarn-monitoring device is installed at each spinning station to monitor yarn thickness during running production. During the piecing of the yarn by a piecing robot that can be presented to a spinning station, the yarn thickness is monitored by means of a second yarn-monitoring device that is built into the automatic spinning unit. On the one hand quality control with respect to yarn thickness is carried out using the results of the second yarn monitoring apparatus, and on the other hand statistical data is collected to optimize the piecing process of the piecing robot. In both instances, measuring data is used that is taken several centimeters upstream and downstream on the yarn from the yarn-piecing joint. The start and the end of measuring is determined by the start of the rotor run-up and the rotor acceleration. However, an additional measurement of the rotor speed is necessary for this. It is however not possible in that case to take into account the exact yarn position of the piecing joint of the current speed of the yarn to determine the yarn defect per length unit.

In a known method to monitor yarn quality of a yarn piecing joint (German patent 196 49 314 A1) the thickness profile of the yarn is also measured a few centimeters before and after a yarn piecing joint, and the measurement is then evaluated based and the precise position of the yarn piecing joint is determined on basis of that evaluation and the quality of the yarn piecing joint is judged by different criteria. In the evaluation it is assumed that the distance between two measuring points measured by the yarn monitoring device along the yarn can be associated with a predetermined measuring resolution without taking into account that the yarn length between two measuring points changes due to the acceleration in the acceleration phase during piecing. The subsequent finding of a yarn-piecing joint based on several measuring points is very time sensitive and therefore results in a delayed recognition of a defect on the yarn-piecing joint or in the adjoining yarn areas. Furthermore, because of the imprecise tarn length assignment to the measuring points, an exact determination of the yarn length defects is not possible.

SUMMARY

It is therefore a principal object of the invention to provide a method and an apparatus to monitor a yarn piecing joint on a spinning machine by means of which simple and precise establishment of the relationship between tarn piecing joint and measuring time or measured value and a precise classification of length and thickness defects in the yarn are possible. Additional objects and advantages of the invention will be set forth in the following description, or may be obvious from the description, or may be learned through practice of the invention.

In an embodiment of the apparatus to monitor a yarn-piecing joint according to the invention, a yarn monitoring apparatus to monitor the yarn quality is installed on a piecing robot or at every spinning station of the spinning machine. Following a yarn breakage or for a bobbin replacement at a spinning station, the piecing robot can be presented to the spinning station, this piecing unit carrying out piecing of the yarn at the piecing station in a known manner.

Based on the piecing values set and optimizable on the piecing robot, the evolution of speed, over time, of the yarn draw-off, i.e. the velocity profile, is calculated in advance from the machine parameters of the piecing robot. Thanks to the transmission of piecing parameters of the piecing robot via a communication system to the yarn monitoring apparatus, the latter receives information concerning the progression of the yarn draw-off during piecing. The piecing parameters can in that case be transmitted continuously in the piecing phase from the piecing robot to the yarn monitoring apparatus, either before the beginning of piecing or at the beginning of piecing.

The piecing parameters may comprise a complete time profile of velocity or only individual acceleration, speed and/or time data from which a velocity-time profile or a yarn position-time profile is calculated first in the yarn monitoring apparatus. Based on the distance from the yarn piecing point to the yarn monitoring apparatus and on the velocity profile, the time can be calculated when the yarn piecing joint runs through the yarn monitoring apparatus. Thereby the characteristic yarn data obtained by the yarn monitoring apparatus can be assigned to the yarn-piecing joint, to the upper yarn of the yarn used for piecing and to the yarn segment following the piecing joint. Derived magnitudes, such as a length-dependent yarn thickness defect, can therefore be calculated exactly.

Additional piecing parameters to be taken into account in the evaluation can be the length of the piecing joint that depends among other things on the drawing-off speed and the rotor diameter at the spinning station. From the starting point and/or the end point of the yarn piecing joint or some other reference value, the yarn monitoring apparatus can then assign the measured values to the yarn-piecing joint via the directly received yarn piecing length or from the calculated yarn piecing length.

The yarn monitoring apparatus to monitor the yarn quality during piecing can in this case be provided at the piecing robot, at the spinning station, or at both. In the latter case, quality monitoring can be carried out at will with either of the two yarn-monitoring apparatuses.

If a yarn monitoring apparatus is provided only at the spinning station, it is used to measure the yarn piecing joint as well as the running yarn. Therefore the manufacturing costs of the spinning machine are reduced and the control expenditure for the spinning machine is simplified considerably since no control device or communication line is necessary for a yarn monitoring apparatus at the automatic spinning unit.

The yarn quality monitored by the yarn monitoring apparatus is in this case preferably the yarn thickness which can be determined e.g. optically. Additional quality parameters that can be monitored alternatively or in addition by the yarn monitoring apparatus are the yarn mass per yarn length that can be determined capacitively for example, spectral properties in order to detect e.g. foreign matters in the yarn, the surface aspect, e.g. as a measure of the emergence of fiber ends from the yarn, which is measured via reflection or distribution, or other physical characteristics.

At the spinning station and/or at the piecing robot it is also possible to provide several yarn monitoring apparatuses, each to monitor different quality parameters of the yarn. The yarn monitoring apparatuses for the different parameters may have common or separate measuring heads and common or separate controls, whereby the latter then receive the piecing parameters of the piecing robot separately, or exchange the calculated velocity profiles.

The yarn monitoring apparatus can in this case be integrated into a modular assembly in which the acquisition of physical measured values of the yarn as well as the evaluation of the measured values, the evaluation of the transmitted piecing parameters and, if applicable, the triggering of a yarn cleaning signal take place. Alternatively, e.g. the acquisition of measured values and their evaluation can take place in separate modular groups or be transferred to other components such as the central controls of the spinning station or spinning machine.

Due to the precise monitoring of yarn quality the optimizing of the piecing process is improved by using the statistical material of the monitoring of the yarn piecing joint so that optimizing is already possible with few measured data and finally the yarn quality can be improved by the greater precision of the optimizing process.

The communication system is in this case ordinarily a communication bus system of the spinning machine through which the controls of the piecing robot transmits piecing parameters to the controls of the monitoring apparatus. Alternatively a direct communication connection between the piecing robot and the yarn monitoring apparatus can be provided. In addition, further parameters such as e.g. the rotor diameter or the nominal yarn production speed can be made available by the central controls of the spinning machine or the spinning station.

A time-dependent piecing speed profile is obtained from the piecing parameters by means of an evaluation unit of the yarn monitoring apparatus, so that the drawing-off speed is known at any point in time and, derived from it, the position of the yarn at any point in time. Thereby a classification of a characteristic yarn value as a function of length can be made, i.e. the cutting out of a defective yarn segment can be initiated.

Upon linking the values calculated from the piecing parameters to the measured characteristic yarn values of the yarn monitoring apparatus, these are stored in a memory so that a statistic on the characteristic yarn values and their distribution can be obtained and used for the classification of the spun yarn and for quality monitoring of the individual spinning station.

If the result of the linkage between the values derived from the piecing parameters and the measured characteristic yarn values is compared to one or more limit values, a cleaning signal is obtained if the limit value is exceeded, causing the corresponding defective location on the yarn to be separated out of the running yarn material. This may be e.g. a defective yarn piecing joint or a thickness deviation in the spun yarn following the yarn-piecing joint.

The calculation of the position of the yarn piecing joint from the piecing parameters is especially improved, so that a differentiation is made between the yarn material near the piecing joint and the yarn material before and/or after the piecing joint. This differentiation can then be used to advantage in establishing separate statistics for the quality of the piecing joint by storing the data relating to it. This also makes it possible, when comparing limit values, to differentiate between the measured characteristic values pertaining to the yarn segment containing the yarn piecing joint and the yarn segment outside the piecing joint, so that different limit values are applied to the yarn piecing joint for quality adjustment. The defect tolerance for the piecing joint can therefore be raised so that, based on the small number of piecing joints over the entire yarn length, exceeding higher limit values is accepted while the limits of defect tolerance for the running yarn are narrowed.

In another embodiment, a running time delay of the communication transmission of the piecing parameters to the yarn monitoring apparatus is compensated for by means of a running time compensation parameter. Thereby synchronization between the piecing event and the assignment of the measured values of the actual yarn position is achieved, independently from the used communication system and its signal durations.

The running time compensation can take place e.g. in such manner that when the piecing parameters have been transmitted to the yarn monitoring apparatus, the beginning of piecing is delayed by a predetermined time span (compensation parameter) equal to the running time of the communication. In this case the compensation for synchronization is effected at the transmitter of the piecing parameters. Otherwise, the piecing start and the start of measuring at the yarn-monitoring apparatus are related to an absolute, common system time (compensation parameter). Furthermore, synchronization can be achieved in that a starting signal is transmitted to the yarn monitoring apparatus or from the yarn monitoring apparatus via a rapid direct communications connection at a reference point in time. A compensation for the running time can also take place at the recipient of the piecing parameters, whereby the yarn monitoring apparatus and possibly yarn cleaning system are activated only after the piecing start.

According to an embodiment of the method to monitor a yarn piecing joint during piecing on a spinning machine, piecing parameters of the piecing robot are also transmitted to a yarn monitoring apparatus so that the advantages described above can be achieved through the method.

In an advantageous embodiment of the method either the yarn quality of the upper yarn, i.e. of the yarn used for piecing, is not measured or the corresponding measured values are not stored. This reduces the quantity of data to be stored. Also, counting double possible defective spots of the upper yarn that should be acquired statistically is thus avoided, since the segment of the upper yarn has already gone through the yarn monitoring apparatus before a yarn breakage and runs again through the yarn monitoring apparatus after piecing.

If, according to an advantageous embodiment of the method, a starting signal is transmitted by the automatic spinning unit to the yarn monitoring apparatus at the moment of starting yarn draw-off, and if at the same time the piecing parameters of the piecing robot are transmitted, a precise synchronization between yarn draw-off and yarn quality measurement is achieved.

If a first point in time when the yarn piecing joint runs through the yarn monitoring apparatus, and a second point in time when the actual yarn draw-off speed reaches the nominal yarn draw-off speed are transmitted as piecing parameters to the yarn monitoring apparatus, the yarn draw-off speed or yarn position can be calculated at any point in time by using the data and an already stored, known yarn draw-off speed characteristic of the automatic yarn piecing unit.

With an alternate embodiment of the method the yarn draw-off speed of the piecing robot is calculated or measured and is continuously transmitted to the yarn monitoring apparatus. Thereby the calculation effort of the yarn monitoring apparatus is reduced and its evaluation electronics can be simplified. In order to determine the point of time when the yarn piecing joint runs through the yarn monitoring apparatus, a signal is transmitted in addition to the yarn draw-off speed data by the piecing robot to indicate the yarn piecing joint to the yarn monitoring apparatus. Thereby a differentiation of the characteristic yarn values from a segment of the yarn piecing joint and also of adjoining yarn segments can be made at the yarn monitoring apparatus.

An example of an embodiment of the invention is explained in further detail below through drawings:

DETAILED DESCRIPTION

Figure 1:
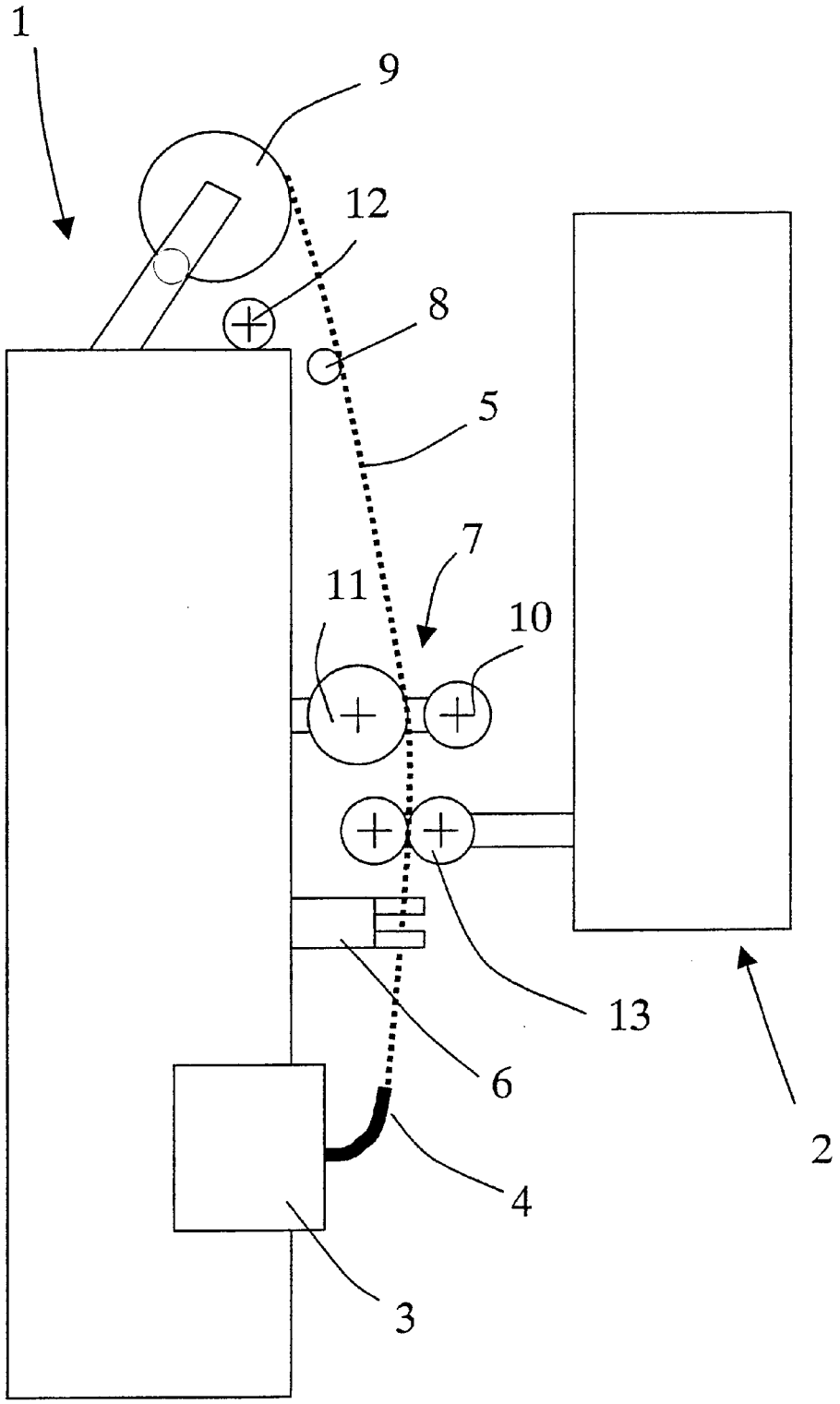
FIG. 1 is a schematic representation of a spinning station of a rotor spinning machine and of a robot that can be brought to the spinning station.

Reference will now be made in detail to one or more embodiments of the invention, examples of which are shown in the drawings. Each example is provided by way of explanation of the invention and not meant as a limitation of the invention. For example, features illustrated or described as part of one embodiment may be used with another embodiment to yield still a further embodiment. It is intended that the invention include these and other modifications and variations.

FIG. 1 schematically shows a spinning station 1 of a rotor spinning machine and a piecing robot 2 brought to the spinning station 1. A spun yarn 5 is drawn off from a spin box 3 of the spinning station 1 through a yarn draw-off tube 4. The yarn 5 is spun in a known manner in the spin box 3 by means of a spinning rotor. Upon emerging from the yarn draw-off tube 4, the yarn 5 runs through a measuring station 6 of a yarn cleaner and in the course of normal spinning operation through a pair of yarn draw-off cylinders 7 and a traversing device 8 to present the yarn to be wound on a cross-wound bobbin 9.

When the yarn 5 is produced at a nominal production speed by the spinning rotor, a billy-roller 10 of the yarn draw-off cylinders 7 presses against the drive roller 11, so that the yarn is held between the billy-roller 10 and the drive roller 11 and is drawn off. Furthermore the cross-wound bobbin 9 lies on the bobbin drive roller 12 during normal production.

The yarn cleaner monitors e.g. the thickness of the yarn 5, and when a defective spot of the yarn exceeds or falls below a predetermined characteristic thickness value, the defective spot is classified into a defect class on the basis of length. If the defective spot exceeds or falls below predetermined specifications, the yarn cleaner causes the removal of the defective spot from the yarn and brings about a forced yarn breakage, e.g. by interrupting the fiber feed to the spinning rotor. For the cleaning of the yarn, a differentiation is made between the running yarn, i.e. in the area of the yarn in which no yarn piecing joint is present, and the area of the yarn piecing joint, and both areas are subjected to separate defect classification. As a result, the defect tolerances for the running yarn and for the yarn piecing joint can be defined independently of each other, e.g. greater thickness deviations are tolerated for the yarn piecing joint. At the same time, separate statistical acquisition takes place in the memory of a control device 23 of the yarn cleaner on the thickness fluctuations of the running yarn and of the yarn piecing joint (see FIG. 2).

The piecing robot 2 cuts out the defective spot and pieces anew. The cutting out and piecing operations take place in this case in a known manner following a yarn breakage or a bobbin replacement. During the piecing phase the yarn is drawn off by a pair of piecing cylinders 13 of the piecing robot 2 instead of by the pair of yarn draw-off cylinders 7 and the cross-wound bobbin 9 is lifted in a manner not shown from the bobbin drive roller 12 and is driven during piecing.

When the yarn has been thrown off into the spinning rotor by a yarn throw-off device (not shown) of the piecing robot 2, the yarn 5 is drawn off at increasing speed and wound up on the cross-wound bobbin 9 by the pair of piecing cylinders 13. Once the yarn draw-off speed has reached the nominal production speed, the drawing off of the yarn is transferred from the pair of piecing cylinders 13 to the pair of yarn draw-off cylinders 7, and the cross-wound bobbin 9 is set down on the bobbin drive shaft 12.

To avoid yarn breakage during the piecing phase and in order to optimize the piecing process, the time between the throwing off of the yarn and the start of yarn draw-off as well as the acceleration behavior of the yarn draw-off system are set by a robot control system 24 of the piecing robot 2. The setting and optimizing of these piecing values takes place as a function of the machine data of the spinning station 1, e.g. the size of the yarn, the material characteristics of the fibers to be spun and the machine data of the piecing robot 2. Because of this variability of the piecing conditions, the acceleration behavior during yarn draw-off, i.e. the speed of the yarn, also changes as a function of time.

Consequently, the piecing values such as waiting time between the throwing off and the drawing off of the yarn as well as the behavior over time of the yarn draw-off acceleration are different from spinning station to spinning station, as they are optimized separately for each spinning station. In addition, the optimized values of a spinning station may change in course of time due to wear. However, from the optimized piecing values of the spinning station 1 and the machine data of the piecing robot 2, it is possible to calculate exactly the speed and at what point in time the yarn 5 runs through the measuring station 6 and when the piecing joint passes the measuring station 6 following piecing. From this data, the piecing parameters are calculated for transmission to the yarn cleaner.

Figure 2:
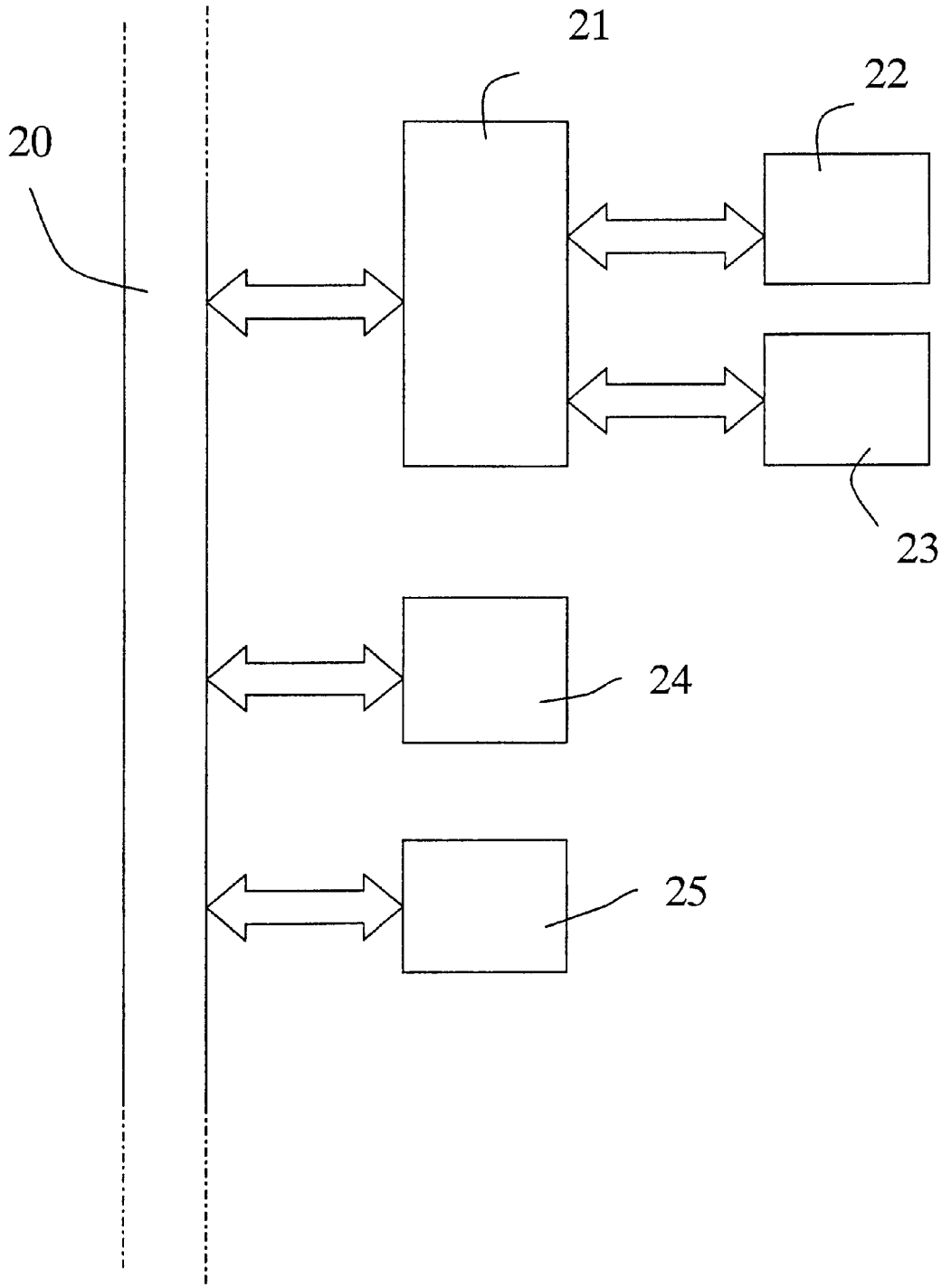
FIG. 2 shows a block diagram of a communications connection between the spinning station and the robot and FIG. 3 is a time diagram of the yarn draw-off speed.

FIG. 2 shows a block diagram of the communications system of the rotor spinning machine on which the control data is exchanged via a communications bus 20 between the different units of the spinning machine. A section controller 21 of the spinning station 1 follows the communications bus 20 and is in turn connected to a spinning station control system 22 of the spinning station 1 and of the controls 23 of the yarn cleaner of the measuring station 6. Furthermore the robot controls 24 of the piecing robot 2 and the machine controller 25 of the drive unit of the spinning machine are connected to the communications bus 20.

The piecing parameters calculated by the robot controls 24 are transmitted via the communications bus 20 to the section controller 21 and from there to the controls 23 of the yarn cleaner. The controls 23 calculates from the piecing parameters of the piecing robot 2 the yarn draw-off speed of the yarn, variable over time, after piecing starts. In addition the point in time at which the yarn piecing joint runs through the measuring station 6 is calculated from this data by using the known yarn length between the spinning rotor and the measuring station 6.

Figure 3:
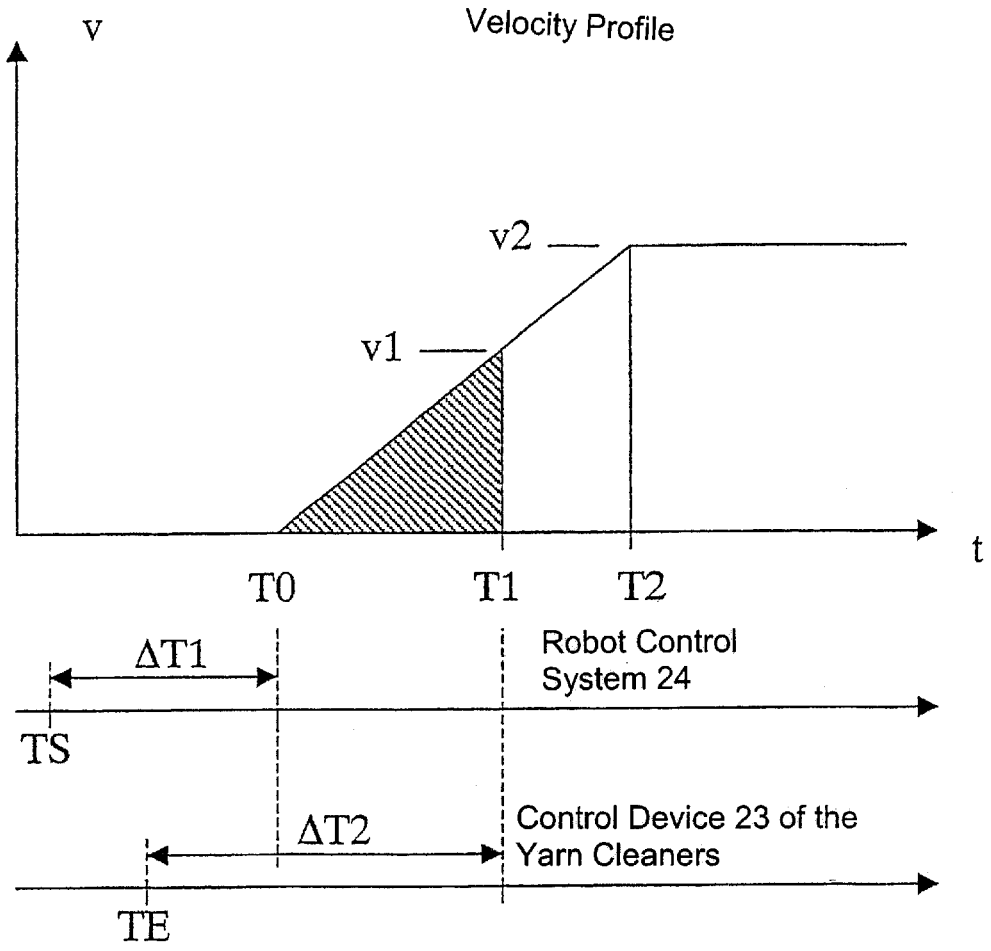

In a first embodiment shown in FIG. 3, the robot controls 24 transmit at a communication time TS the starting time T0 for piecing, a cleaning starting time T1, an intermediate speed v1 and a delivery speed time T2 to the controls 23 of the yarn cleaner. The controls 23 receive these parameters at reception time TE. In the upper diagram of FIG. 3 the yarn draw-off speed v over time is entered.

After the communication time TS piecing is delayed by the compensation time ΔT1 so that the parameter may be transmitted reliably and so that the yarn cleaner may be prepared for the evaluation of the measured values. The yarn cleaner determines from the reception time TE and the time of cleaning start T1 the waiting time T2 following which the cleaning process is actuated. The piecing robot 2 is synchronized with the yarn cleaner by using the two time delays ΔT1 and ΔT2.

Yarn draw-off begins at the starting time T0 at the speed v=0. The starting time T1 for cleaning is the time when the yarn piecing joint runs through the measuring station 6 or has run through it. At the same time the yarn cleaner begins at that time to monitor the yarn quality and possibly starts the yarn cleaning process. Thereby the start of a yarn cleaning process before the yarn piecing joint has reached the measuring head or has run through it is prevented.

The speed progression of the yarn draw-off speed is calculated by the controls 23 of the yarn cleaner from the intermediate speed v1 at time T1, it being assumed in this example of an embodiment that the acceleration between the starting time T0 and the delivery speed time T2 is linear. At the point in time T2 the yarn draw-off speed has reached the nominal delivery speed v2 which depends only on the setting of the spinning machine and has already been preset as a parameter during yarn cleaning.

In another embodiment, the time T2 is subject to the two conditions that at this point in time the delivery speed, i.e. the nominal yarn production speed, has been reached on the one hand, and on the other hand that the yarn piecing joint has already run through the measuring station 6.

In another embodiment, any speed acceleration profile can be assumed instead of the linear acceleration between times T0 and T2, whereby v1 is a parameter for the adaptation of the speed profile calculated in the yarn cleaner to the speed profile actually selected on the piecing robot 2 while taking into account the yarn production speed v2.

Another embodiment of the yarn cleaning or monitoring process provides for the yarn quality monitoring to start at time T0, and yarn cleaning at time T2. Alternatively the yarn monitoring and yarn cleaning can be actuated only after time T2 (T2≦T1). It should be appreciated by those skilled in the art that modifications and variations can be made to the apparatus and method described herein without departing from the scope and spirit of the invention.

What is claimed is:

1. A method for monitoring a yarn piecing joint at a spinning station in a spinning machine having a plurality of spinning stations, the spinning machine having a piecing robot equipped with a yarn piecing apparatus that operates at an adjustable yarn piecing speed, each spinning station of the spinning machine having a yarn monitoring apparatus to monitor at least one yarn quality characteristic of yarn produced at the respective spinning station, said method comprising transmitting piecing parameters from the piecing robot to the individual yarn monitoring apparatuses and assigning yarn length positions to the yarn characteristics measured by the yarn monitoring apparatuses for evaluating the piecing joint based on the piecing parameters supplied by the piecing robot.

2. The method as in claim 1, further comprising calculating and storing yarn quality values from the yarn length positions and corresponding measured yarn characteristics.

3. The method as in claim 2, further comprising storing the yarn quality values separately for each spinning station.

4. The method as in claim 2, further comprising using the stored quality values for a spinning station to optimize operation of the piecing robot at the respective spinning station.

5. The method as in claim 2, wherein yarn quality values of the upper yarn preceding the piecing joint are not computed and stored.

6. The method as in claim 2, further comprising conducting a yarn cleaning operation at the spinning stations if the calculated yarn quality values exceed predetermined limit values assigned to the respective yarn qualities.

7. The method as in claim 6, wherein yarn quality values of the piecing joint are compared to predetermined limit values.

8. The method as in claim 1, further comprising calculating the yarn length position of the piecing joint from the piecing parameters.

9. The method as in claim 1, wherein the piecing parameters are transmitted by the piecing robot to the yarn monitoring apparatus at the beginning of yarn draw off after a piecing operation.

10. The method as in claim 1, wherein the piecing parameters include a first point in time corresponding to when the piecing joint runs through the yarn monitoring apparatus or just after, and a second point in time corresponding to when actual yarn draw off speed reaches nominal draw off speed.

11. The method as in claim 10, further comprising satisfying the condition that the yarn piecing joint has run through the yarn monitoring apparatus before the second point in time is measured.

12. The method as in claim 10, wherein the piecing parameters include yarn draw off speed at the first point in time.

13. The method as in claim 10, wherein the piecing robot measures actual current yarn draw off speed at the spinning station.

14. The method as in claim 13, wherein the piecing robot continuously transmits current actual yarn draw off speed to the yarn monitoring apparatus.

15. The method as in claim 14, wherein the piecing robot transmits to the yarn monitoring apparatus when the piecing joint runs through the yarn monitoring apparatus.

16. The method as in claim 1, further comprising using a time compensation factor to ensure synchronization between the measured yarn characteristics and yarn length position.

17. An apparatus for monitoring a yarn piecing joint at a spinning station of a spinning machine having a plurality of the spinning stations and a yarn piecing robot that is brought to the individual spinning stations for piecing, said apparatus comprising at least one yarn monitoring apparatus configured for measuring yarn characteristics at a respective spinning station, a communication system through which said piecing robot transmits piecing parameters of the piecing robot to the yarn monitoring apparatus, and wherein said yarn monitoring apparatus comprises an evaluation unit for computing at least one of the variable of piecing speed, a speed profile (dv/dt), and a yarn position from the piecing parameters transmitted by said piecing robot during a piecing operation.

18. The apparatus as in claim 17, wherein said evaluation unit links measured yarn characteristic values with said computed variable and stores the linked results in a memory.

19. The apparatus as in claim 18, wherein said linked results are compared to set point limit values, said evaluation unit generating a yarn cleaning signal upon said limit values being exceeded by said linked results.

20. The apparatus as in claim 17, wherein said evaluation unit computes a position of the piecing joint from said piecing parameters and assigns to said position corresponding yarn characteristic values.

21. The apparatus as in claim 17, wherein said piecing parameters include values for piecing speed and a time reference value for the start of a piecing operation.

22. The apparatus as in claim 17, comprising a plurality of said yarn monitoring apparatuses for detecting and measuring different yarn quality characteristics.

* * * * *